United States Patent [19]

Leonard et al.

[11] Patent Number: 4,588,034

[45] Date of Patent: May 13, 1986

[54] VIBRATORY PLOW BLADE

[75] Inventors: Emil T. Leonard; Robert G. Draney, both of Wichita, Kans.

[73] Assignee: J. I. Case Company, Racine, Wis.

[21] Appl. No.: 674,892

[22] Filed: Nov. 26, 1984

[51] Int. Cl.[4] ..... A01B 13/08

[52] U.S. Cl. ..... 172/40; 172/699

[58] Field of Search ..... 172/40, 700, 699, 713; 37/193; 405/182

[56] References Cited

U.S. PATENT DOCUMENTS

| | | | |
|---|---|---|---|
| 2,632,265 | 3/1953 | Ryan | 172/699 |
| 3,326,010 | 6/1967 | Gagne | 172/40 X |
| 3,390,533 | 7/1968 | Gremillion | 172/40 X |
| 3,684,030 | 8/1972 | Lucero | 172/700 |
| 3,777,500 | 12/1973 | Kelley | 172/40 |
| 4,127,073 | 11/1978 | Blair | 172/700 |
| 4,164,982 | 8/1979 | Draney | 172/40 |
| 4,200,410 | 4/1980 | Baker | 405/182 |

FOREIGN PATENT DOCUMENTS

| | | | |
|---|---|---|---|
| 386096 | 9/1973 | U.S.S.R. | 172/699 |
| 676197 | 7/1979 | U.S.S.R. | 172/40 |

*Primary Examiner*—Richard J. Johnson

*Attorney, Agent, or Firm*—Cullen, Sloman, Cantor, Grauer, Scott & Rutherford

[57] ABSTRACT

A vibratory plow blade which increases the efficiency of the plowing action. The tapered leading edge of the plow blade includes a plurality of saw-like teeth or serrations. The uppermost serration acts as a soil cutter as the plow blade moves along the ground slot formed by the blade during vibration, thereby relieving surface tension created by packed soil or sod. The intermediate serration provides an upward fracturing of the subsoil with each successive up stroke from the vibratory action. This fracturing reduces the amount of work required to move the plow blade through the soil in the direction of plowing. The lower serration also provides an upward fracturing of the deep subsoil directly above the serration. Further, the upper leading edge of the lower serration is sloped to a greater extent than the upper leading edges of the other serrations to provide blade pull for maintaining the proper plowing depth during the plowing operation. Finally, the bottom edge of the plow blade is tapered to reduce soil resistance as the plow blade is returned to the lowest point in the stroke during vibratory motion for wedging the soil away from the blade.

2 Claims, 6 Drawing Figures

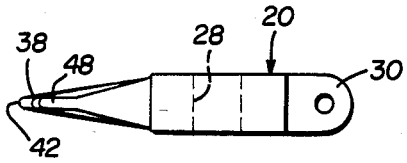
FIG. 4
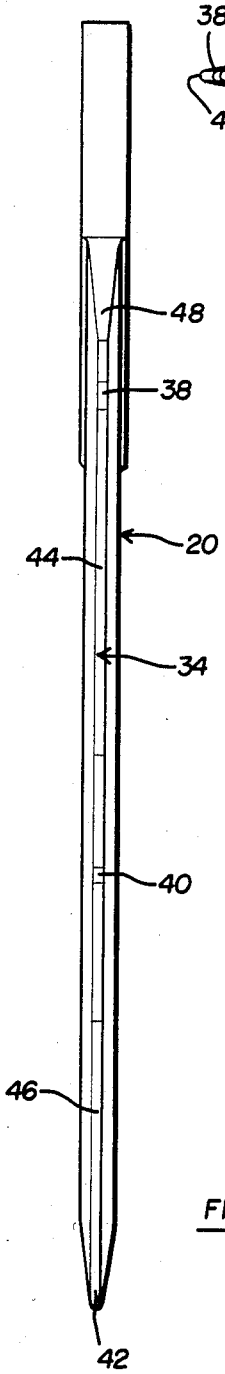
FIG. 3
FIG. 5
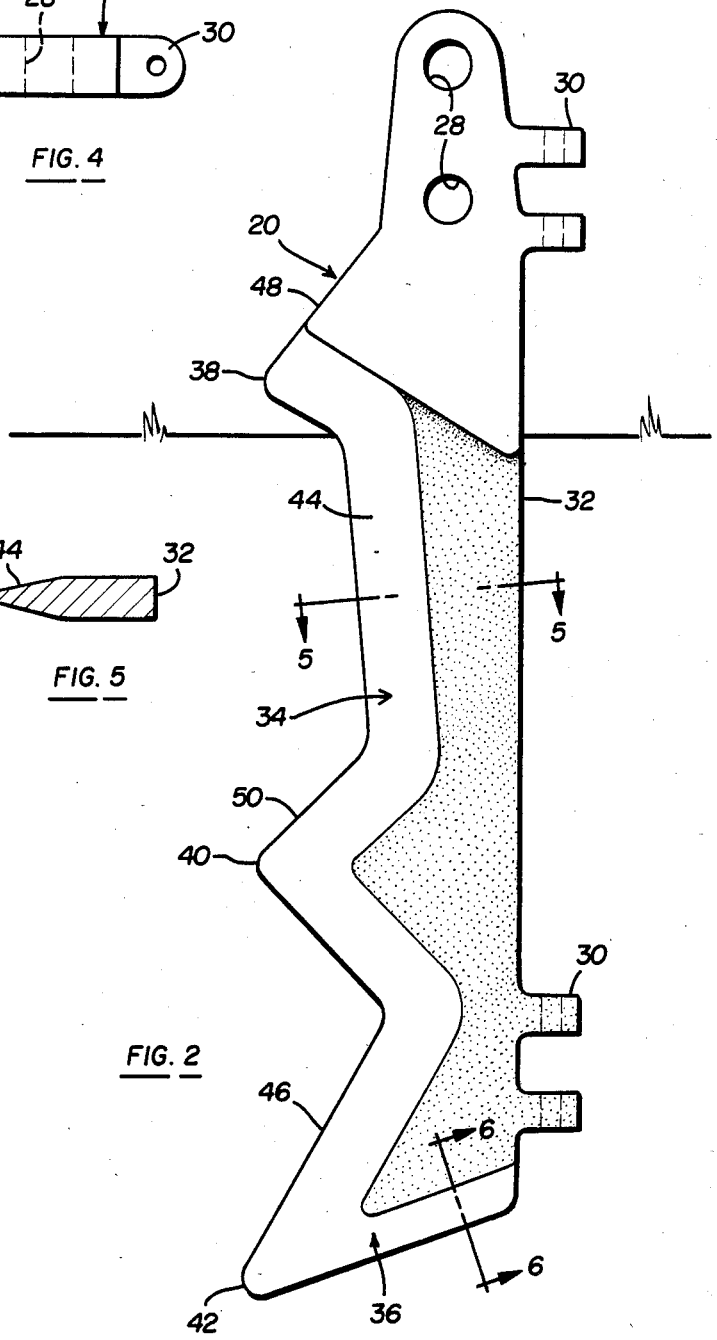
FIG. 2
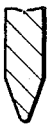
FIG. 6

VIBRATORY PLOW BLADE

BACKGROUND OF THE INVENTION

The present invention relates generally to a vibratory plow assembly which is adapted to lay cable, flexible pipe and the like under ground in the cut made by a blade wherein the blade is vibrated to reduce the force required to pull the blade through the ground. More particularly, the present invention relates to a plow blade construction which provides for improved vibratory plowing.

Vibratory cable plows have been used for several years to lay cable, flexible pipe and the like under ground. The cable or pipe may be either pulled through the cut of the plow blade or a cable chute may be provided on the trailing edge of the plow blade which guides the cable or pipe into the ground from a drum mounted on the tractor or other vehicle. Various types of vibrators have been mounted on the plow blade or the vibrator and blade have been suspended together on a resilient frame assembly to generate either vertical or orbital motion in the plow blade. Examples of such prior art vibratory plows are disclosed in U.S. Pat. Nos. 4,040,261, 3,618,237 and 3,363,423, all assigned to the assignee of the present application.

While vibration of the plow blade of a cable laying plow results in several advantages including less ground disturbance and faster cable laying installation, it has now been discovered that the plow blade may be constructed in a way that adds to the efficiency of the vibratory plowing action. In particular, a plow blade constructed in accordance with the teachings of the present invention will substantially reduce the force required to cut the earth and pull the blade through the ground.

SUMMARY OF THE INVENTION

The vibratory plow blade of the present invention includes a vertically extending lead or ground slitting edge at the forward end thereof which is angled slightly to reduce drag and wear while still providing the necessary strength required. A cable guide is supported on the rear edge of the blade for receiving a cable which is continuously fed into and along the bottom of a ground slit formed by the blade. The blade is fixedly supported to a shaker frame having a power driven oscillating mechanism supported thereon for reciprocating the blade vertically between upper and lower limits. The blade, shaker frame and oscillating mechanism are suspended on a vehicle such as a conventional tractor.

The plow blade of the present invention is constructed along its leading edge and bottom edge to provide for improved vibratory plowing. In particular, the tapered leading edge of the plow blade includes a plurality of saw-like teeth or serrations, each performing a unique function for increasing the efficiency of the plowing action. The uppermost tooth or serration acts as a soil or sod cutter as the plow blade moves along the ground slot formed by the blade during vibration. That is, after the plow blade is positioned into the soil, the upper serration provides a cut in the soil with each successive down stroke from the vibratory action thereby relieving surface tension created by packed soil or sod.

An intermediate tooth or serration is separated from the upper serration by a portion of the leading edge which is generally parallel to the trailing edge of the plow blade. The intermediate serration provides an upward fracturing of the subsoil with each successive up stroke from the vibratory action. This fracturing reduces the amount of work required to move the plow blade through the soil in the direction of plowing.

A lower tooth or serration also provides an upward fracturing of the deep subsoil directly above the serration with each successive up stroke from the vibratory action. The upper leading edge of the lower serration is sloped to a greater extent, relative to horizontal, than the upper leading edges of the other serrations. This provides for some downward blade pull to maintain the proper plowing depth during the plowing operation. Thus, the localized fracturing provided by the intermediate and lower serrations permits a more efficient working in tightly compacted soil by spreading the fracturing over a plurality of areas which lessens soil resistance and increases productivity.

Finally, the bottom edge of the plow is also tapered to reduce soil resistance that is created as the plow blade is returned to the lowest point in the stroke during vibratory motion. This taper wedges the soil away from the blade and reduces the amount of adhering soil which would cause additional drag.

Other advantages and meritorious features of the vibratory plow blade of the present invention will be more fully understood from the following description of the invention, the appended claims and the drawings, a brief description of which follows.

BRIEF DESCRIPTION OF DRAWINGS

FIG. 2 is a side elevational view of the vibratory plow blade of the present invention.

FIG. 3 is a front view of the plow blade.

FIG. 4 is a top plan view of the plow blade.

FIG. 5 is a cross-sectional view taken along line 5—5 in FIG. 2.

FIG. 6 is a cross-sectional view taken along line 6—6 in FIG. 2.

DETAILED DESCRIPTION OF THE INVENTION

Figure 1:
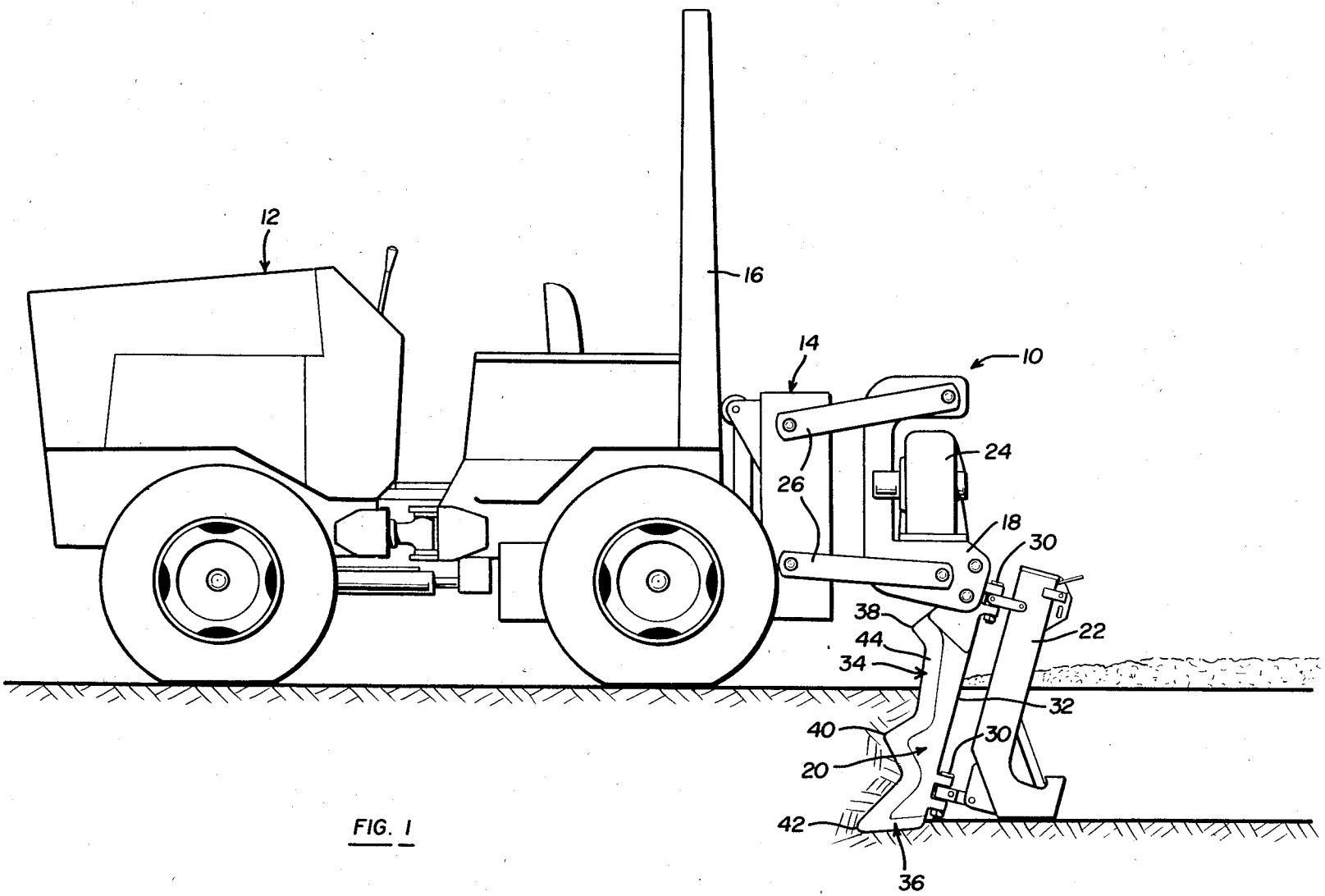
FIG. 1 is a side elevational view of a tractor and vibratory cable laying plow having the plow blade of the present invention.

Referring to FIG. 1, a vibratory plow assembly 10 is connected to the rear of vehicle 12, which may be a tractor, bulldozer or the like. Generally, the vibratory plow assembly 10 includes a vertical mast assembly 14 which is attached to vehicle rear frame portion 16, a vertical shaker frame 18, and a plow blade 20, made in accordance with the present invention. Blade 20 has a cable guide 22 supported thereon for receiving a cable (not shown) which is continuously fed into and along the bottom of the ground slot formed by blade 14, as is conventional.

The upper end of blade 20 is fixedly supported to the generally C-shaped shaker frame 18. Shaker frame 18 has a power driven oscillating mechanism 24 supported thereon for reciprocating blade 20 vertically between upper and lower limits. Blade 20, cable guide 22, shaker frame 18 and oscillating mechanism 24 are suspended from mast assembly 14 by upper and lower pairs of connecting links 26. As is conventional, the oscillating mechanism 24 is adapted to vibrate blade 20 and thereby transmit an arcuate or orbital motion to the blade.

Referring now to FIGS. 2–6, the plow blade 20 of the present invention is shown in greater detail. The upper end of plow blade 20 includes openings 28 for permitting the attachment of blade 20 to shaker frame 18. Further, lugs 30 are provided on the rear or trailing edge 32 of blade 20 for permitting cable chute 22 to be attached thereto. The present invention, however, relates to the construction of plow blade 20 along its tapered leading edge 34 and tapered bottom edge 36, which provides for improved vibratory plowing. In particular, the tapered leading edge 34 of plow blade 20 includes a plurality of saw-like teeth or serrations 38, 40 and 42, each performing a unique function for increasing the efficiency of the plowing action.

The uppermost tooth or serration 38 acts as a soil or sod cutter as plow blade 20 moves along the ground slot formed by the blade during vibration. That is, after the plow blade is positioned into the soil as generally shown in FIG. 6, the upper serration 38 provides a cut in the soil with each successive down stroke from the vibratory action thereby relieving surface tension created by packed soil or sod.

The intermediate tooth or serration 40 is separated from the upper serration 38 by a portion 44 of the leading edge which is generally parallel to the trailing edge 32 of plow blade 20. The intermediate serration 40 provides an upward fracturing of the subsoil with each successive up stroke from the vibratory action. This fracturing reduces the amount of work required to move the plow blade 20 through the soil in the direction of plowing.

The lower tooth or serration 42 also provides an upward fracturing of the deep subsoil directly above the serration with each successive up stroke from the vibratory action. As shown in FIG. 6, the upper leading edge 46 which forms serration 42 is sloped to a greater extent, relative to horizontal, than the upper leading edges 48 and 50 of the other serrations. This provides for downward blade pull to maintain the proper plowing depth during the plowing operation. Thus, the localized fracturing provided by serrations 40 and 42 permits a more efficient working in tightly compacted soil by spreading the fracturing over a plurality of areas which lessens soil resistance and increases productivity.

Finally, the bottom edge 36 of plow blade 20 is tapered, as shown in FIG. 6, to reduce soil resistance that is created as the plow blade 20 is returned to the lowest point in the stroke during vibratory motion. This taper wedges the soil away from the blade and reduces the amount of adhering soil which would cause additional drag.

It will be apparent to those skilled in the art that the foregoing disclosure is exemplary in nature, rather than limiting, the invention being limited only by the appended claims.

We claim:

1. In a vibratory plow for laying cable, pipe and the like under ground including a prime mover, an elongated plow blade mounted on a blade support frame, said blade support frame having a vibrator for transmitting orbital motion to said plow blade for forming a ground slot, the improvement comprising:

said plow blade having a leading edge, a trailing edge and a bottom edge, said leading edge being tapered and including a plurality of serrations along its length, an upper serration for cutting soil during each successive down stroke as the plow blade moves along the ground slot formed by the blade during vibration thereby relieving surface tension, an intermediate serration providing an upward fracturing force on subsoil with each successive upward stroke of the plow blade, and a lower serration providing an upward fracturing force on deep subsoil during each successive upward stroke of the plow blade;

each serration includes an upper leading edge and the upper leading edge of said lower serration being sloped to a greater extent, relative to horizontal, than the upper leading edges of the other serrations for assisting in the maintenance of a proper plowing depth; and wherein the upper serration is separated from the intermediate serration by a portion of the leading edge which is generally parallel to the trailing edge of the plow blade.

2. In a vibratory plow for laying cable, pipe and the like under ground including a prime mover, an elongated plow blade mounted on a blade support frame, said blade support frame having a vibrator for transmitting orbital motion to said plow blade for forming a ground slot, the improvement comprising:

said plow blade having a leading edge, a trailing edge, and a bottom edge, said leading edge being tapered and including a plurality of serrations along its length;

an upper serration for cutting soil during each successive downward stroke as the plow blade moves along the ground slot formed by the blade during vibration thereby relieving surface tension;

an intermediate serration providing an upward fracturing force on subsoil with each successive upward stroke of the plow blade, and the upper serration separated from the intermediate serration by a portion of the leading edge which is generally parallel to the trailing edge of the plow blade;

a lower serration providing an upward fracturing force on deep subsoil during each successive upward stroke of the plow blade, and wherein each serration including an upper leading edge with the upper leading edge of said lower serration being sloped to a greater extent, relative to horizontal, than the upper leading edges of the other serrations for assisting in the maintenance of a proper plowing depth; and said bottom edge of the plow blade being tapered to wedge the soil away from the blade for reducing soil resistance when the plow blade is returned to the lowest point in the stroke during vibratory motion.

* * * * *